United States Patent [19]

Gustafson

[11] Patent Number: 5,032,436

[45] Date of Patent: Jul. 16, 1991

[54] FRAME FOR USE WITH PHOTOGRAPHS

[75] Inventor: Donald E. Gustafson, North St. Paul, Minn.

[73] Assignee: Minnsota Mining and Manufacturing Company, Saint Paul, Minn.

[21] Appl. No.: 419,697

[22] Filed: Oct. 11, 1989

[51] Int. Cl.[5] ..... A47G 1/06

[52] U.S. Cl. ..... 428/14; 40/158.1; 428/45

[58] Field of Search ..... 40/158.1; 229/92.8; 428/13-14, 45

[56] References Cited

U.S. PATENT DOCUMENTS

| | | | |
|---|---|---|---|
| Re. 24,906 | 12/1960 | Ulrich | 428/480 X |
| 2,884,126 | 4/1959 | Ulrich | 428/480 X |
| 3,024,553 | 3/1962 | Rowley | 40/158.1 |
| 3,691,140 | 9/1972 | Silver | 524/814 X |
| 4,079,881 | 3/1978 | Sabb | 229/92.8 |
| 4,231,833 | 11/1980 | Lieberman | 428/14 X |
| 4,237,633 | 12/1980 | Murrell | 229/92.8 X |
| 4,662,093 | 5/1987 | Suttles et al. | 428/14 X |
| 4,809,451 | 3/1989 | Suzuki | 40/158.1 |
| 4,864,755 | 9/1989 | Owens | 40/158.1 X |

*Primary Examiner*—Henry F. Epstein

*Attorney, Agent, or Firm*—Gary L. Griswold; Walter N. Kirn; William L. Huebsch

[57] ABSTRACT

A frame adapted for use on a photograph including a flexible conformable sheet having length and width dimensions exceeding the length and width dimensions of the photograph by at least 12.7 millimeter (0.5 inch), a generally centrally located viewing opening having a size and shape adapted to afford viewing of a central portion of the photograph with edge portions of the photograph around the central portion extending along the rear surface of the sheet; and a layer of adhesive along the rear surface of the sheet, the adhesive affording firm adhesion and conformance of the sheet to the edge portions of the photograph to hold the photograph against the frame and adhesion of the sheet around the photograph to a smooth firm surface to thereby support the photograph and frame along the surface, while being removable from the surface and portion of the photograph without damage thereto. The surface to which the frame and photograph is adhered could be that of a wall, refrigerator, etc., or that of a special greeting card used in combination with the frame.

12 Claims, 2 Drawing Sheets

FRAME FOR USE WITH PHOTOGRAPHS

TECHNICAL FIELD

The present invention relates to inexpensive frames of paper or polymeric materials for use with photographs.

BACKGROUND ART

Inexpensive frames of paper or polymeric materials including adhesives and adapted for use with photographs are well known in the art, U.S. Pat. Nos. 3,024,553, 4,079,881, 4,237,633, and 4,662,093 providing illustrative examples. Heretofore, however, such frames have either been adapted to attach themselves so firmly to a photograph that they could not be removed without damage thereto, have required multiple coatings of different types of adhesive, or have not adhered sufficiently well to the photograph to provide display of the photograph over an extended period of time.

DISCLOSURE OF INVENTION

The present invention provides a frame for a photograph that is simple to manufacture, affords displaying the photograph over an extended period of time without separating therefrom, and can subsequently be removed from the photograph without damage to the photograph or to surfaces to which the frame attaches the photograph.

According to the present invention there is provided a frame adapted for use on a photograph of a predetermined size or range of sizes, which frame comprises a flexible conformable sheet having a thickness of up to about 0.2 millimeter (0.008 inch), a peripheral edge between its major front and rear surfaces having length and width dimensions exceeding the length and width dimensions of the photograph by at least about 12.7 millimeters (0.5 inch), and a generally centrally located viewing opening between the surfaces having a size and shape adapted to afford viewing of a central portion of the photograph with edge portions of the photograph along its rear surface. The frame has a layer of adhesive along its rear surface that affords firm adhesion and conformance of the sheet to the edge portions of the photograph to hold the photograph against the frame, and adhesion of the sheet around the photograph to a surface to thereby support the photograph and frame along the surface, while being removable from the surface and portion of the photograph without damage thereto.

In a preferred embodiment of the frame the adhesive is a mixture of a permanent isooctyl acrylate/acrylic acid copolymer pressure sensitive adhesive and a repositionable pressure sensitive adhesive comprising inherently tacky elastomeric acrylate microspheres which are solid in nature, comprises from 5 to 20 percent and preferably 15 percent of the permanent pressure sensitive adhesive and from 95 to 80 percent and preferably 85 percent of the repositionable pressure sensitive adhesive, and is applied in a layer weighing in the range of 8.37 to 16.75 grams and preferably 12.56 grams per square meter (2 to 4 grains and preferably 3 grains for a square measuring 4 inches by 6 inches).

The sheet can be of paper (e.g., paper cover stock weighing up to 29.5 kilograms (65 pounds) per ream) or of polymeric material (e.g., polyester in the range of 0.076 to 0.2 millimeter (0.003 to 0.008 inch) thick), the main requirement being that the sheet is flexible and can conform to the surface and edge of a photograph so that the adhesive can firmly adhere thereto, and the adhesive will not be pealed from the sheet by internal forces in the photograph and in the sheet that are tending to separate them.

The surface to which the frame is adapted to attach the photograph can be the surface of a glass or polymeric sheet such as in a window, a wood panel such as on a door or desk, a painted metal panel such as that of a refrigerator, etc.; or the specially treated surface of a greeting card that can be provided in combination with the frame and has a peripheral edge between its major front and rear surfaces having length and width dimensions about the same as or slightly greater than the length and width dimensions of the sheet, printed indicia such as a greeting on the rear surface, and a coating of release material on the front surface affording firm adhesion of the layer of adhesive on the sheet around the photograph to the front surface of the greeting card to thereby support the photograph and frame along the front surface, while affording removal of the layer of adhesive from the front surface of the greeting card without damage thereto.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
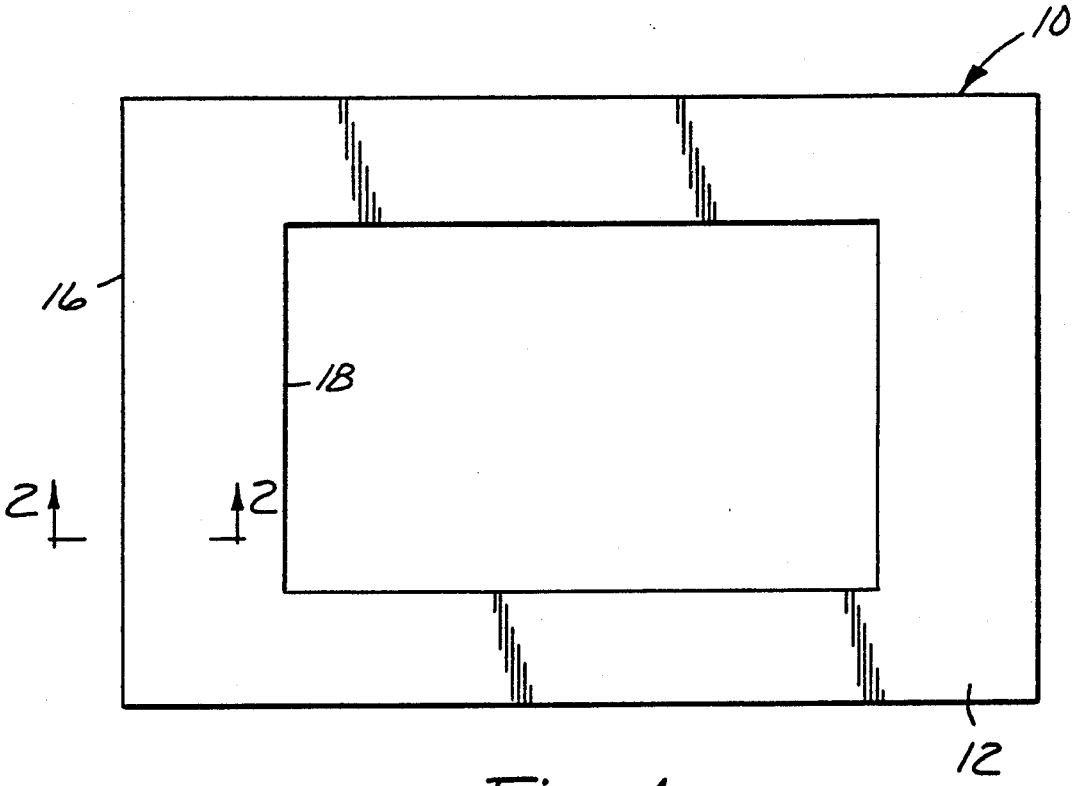
FIG. 1 is a front view of a frame according to the present invention for use with a photograph.

Referring now to the drawing, there is shown a frame according to the present invention generally designated by the reference numeral 10.

Figure 4:
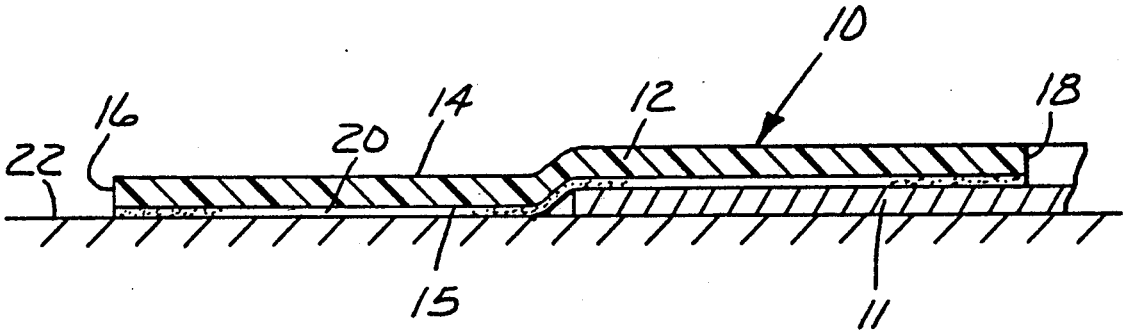
FIG. 4 is an enlarged fragmentary sectional view taken approximately along line 4–4 of FIG. 3.
Figure 3:
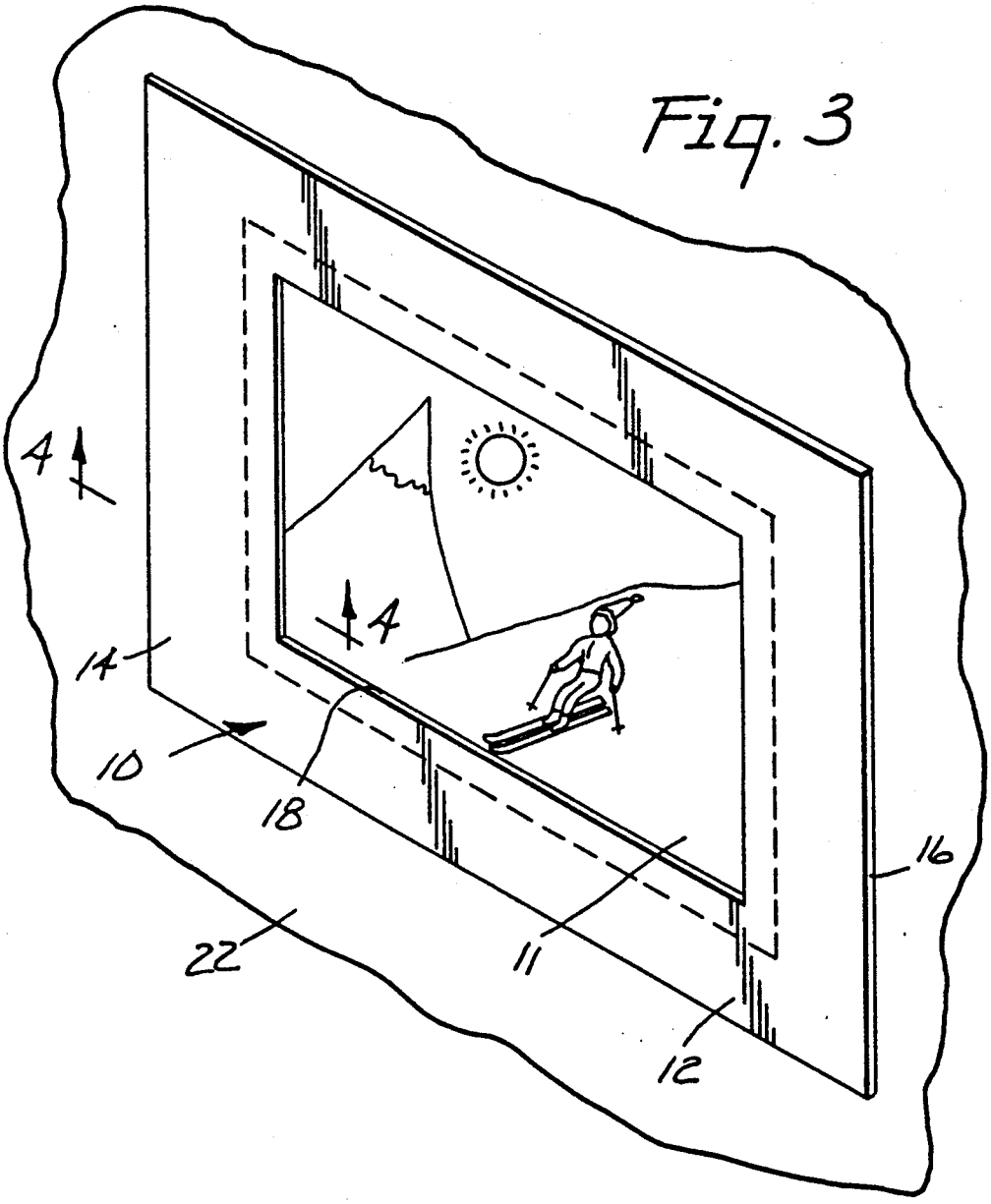
FIG. 3 is a perspective view of the frame of FIG. 1 being used to attach a photograph to a surface.

Generally the frame 10 is adapted for use with a photograph 11 (FIGS. 3, 4 and 5) of a single size or in a predetermined typically small range of sizes, and comprises a flexible conformable sheet 12 having a thickness of up to about 0.2 millimeter, opposite front and rear major surfaces 14 and 15, a peripheral edge 16 between the major surfaces 14 and 15 having length and width dimensions exceeding the length and width dimensions of the photograph 11 by at least about 12.7 millimeter, a generally centrally located rectangular viewing opening 18 between the surfaces 14 and 15 having a size and shape adapted to afford viewing of a central portion of the photograph 11 with edge portions of the photograph 11 around the central portion extending along the rear surface 15; and a layer 20 of adhesive along the rear surface 15 of the sheet 12, the layer 20 of adhesive affording firm adhesion and conformance of the sheet 12 to the edge portions of the photograph 11 to hold the photograph 11 against the frame 10 and adhesion of the sheet 12 around the photograph 11 to a smooth firm surface 22 (e.g., a surface of a glass or polymeric sheet, a wood panel, a painted metal panel, etc.) to thereby support the photograph 11 and frame 10 along the surface 22 as is illustrated in FIGS. 3 and 4, while the frame 10 is removable form the surface 22 and portion of the photograph 11 around the viewing opening 18 without damage to either.

The adhesive in the layer of adhesive 20 can be a mixture of a permanent isooctyl acrylate/acrylic acid copolymer pressure sensitive adhesive described in U.S. Pat. Re. 24,906 (the content whereof is incorporated herein by reference) and a repositionable pressure sensitive adhesive comprising inherently tacky elastomeric acrylate microspheres which are solid in nature and are prepared by aqueous suspension polymerization of alkyl acrylate monomers and ionic comonomers, which repositionable adhesive is described in U.S. Pat. No. 3,691,140 (the content whereof is incorporated herein by reference). The mixture of those adhesives should comprise from 5 to 20 percent and preferably 15 percent of the permanent pressure sensitive adhesive and from 95 to 80 percent and preferably 85 percent of the repositionable pressure sensitive adhesive. Also, preferably that adhesive mixture is applied to the rear surface 15 of the sheet 12 in a layer weighing in the range of 8.37 to 16.8 grams and preferably 12.6 grams per square meter after the rear surface 15 is primed by a suitable primer, such as the vinyl chloride polymer and zinc oxide primer commercially designated VAGH that is available from Union Carbide Corporation, Danbury, Conn. Alternatively, other adhesives that could provide the desired level of adhesion and removability with respect to photographs and the type of surfaces indicated above could be used.

Figure 2:
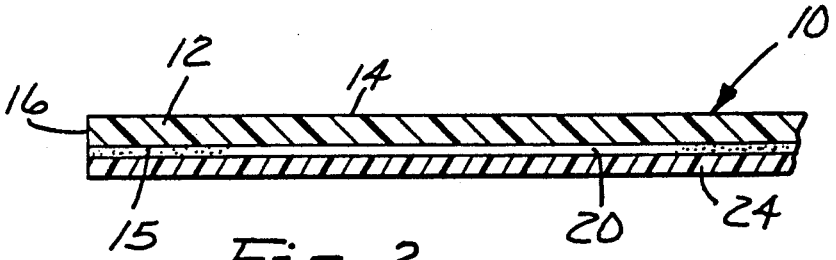
FIG. 2 is an enlarged fragmentary sectional view taken approximately along line 2—2 of FIG. 1.

The frame 10 can also include a manually removable release liner 24 (FIG. 2) overlaying the side of the coating 20 of adhesive opposite the sheet 12, such as the silicone release liner commercially available from Daubert Chemical Company, Chicago, Ill. under the trade designation "2-60BKG-4000 and 4030" of which the latter two numbers refer to different coatings on the major sides of the release liner which is preferably used with the side designated "4030" against the layer 20 of adhesive.

Figure 5:
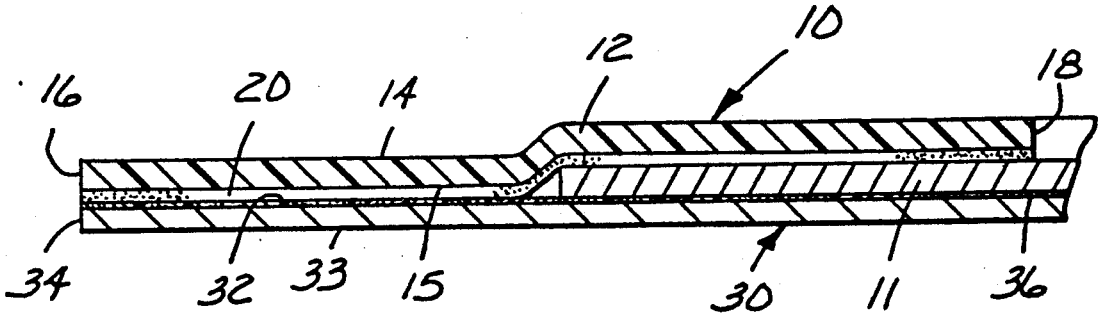
FIG. 5 is an enlarged fragmentary view of the frame of FIG. 1 being used to attach a photograph to a special greeting card used in combination with the frame.

As is illustrated in FIG. 5, the frame 10 can also be used in combination with a paper greeting card 30 having opposite front and rear major surfaces 32 and 33, a peripheral edge 34 between the major surfaces 32 and 33 having length and width dimensions about the same as or slightly larger than the length and width dimensions of the sheet 12, printed indicia such as a birthday or vacation greeting on the rear surface 33, and a coating 36 of a release material over the front surface 32 affording firm adhesion of the layer 20 of adhesive on the sheet 12 around the photograph 11 along the front surface 32 of the greeting card 30 to thereby support the photograph 11 and frame 10 along the front surface 32, while affording removal of the layer 20 of adhesive form the front surface 32 of the greeting card 30 without damage thereto. Preferably the release material in the coating 36 consists of a mixture by weight of 30 parts of PS-849 pendant functional mercaptopolydiorganosiloxane of 100–200 centistokes viscosity (available from Huls America Inc.), 100 parts of methyl acrylate, 75 parts of acrylic acid, 307.5 parts of methylethyl ketone, and 0.5 parts of 2,2'-azobisisobutyronitrile (AIBN), which mixture is reacted by being mixed for 16 hours at a constant temperature of 55 degrees Centigrade.

The frame 10 according to the present invention has now been described with reference to one embodiment thereof used alone or in combination with the greeting card 30. It will be apparent to those skilled in the art that many changes can be made in the embodiment of the frame 10 described and that the frame could be used in other combinations without departing from the scope of the present invention. Thus the scope of the present invention should not be limited to the structure described in this application, but only by structures described by the language of the claims and the equivalents of those structures.

I claim:

1. A frame adapted for use on photographs in a predetermined range of sizes, said frame comprising:

a flexible conformable generally planar sheet having a thickness of up to about 0.20 millimeters. opposite front and rear major surfaces, a peripheral edge between said major surfaces having length and width dimensions exceeding the length and width dimensions of photographs in said predetermined range of sizes by at least 12.7 millimeters, a generally centrally located viewing opening between said surfaces having a size and shape adapted to afford viewing of a central portion of a photograph in said range of sizes with edge portions of the photograph around said central portion extending along said rear surface; and a layer of repositioning pressure sensitive adhesive along said rear surface of said sheet, said adhesive affording firm adhesion and conformance of said sheet to the edge portions of the photograph extending along said rear surface to hold the photograph against the sheet and afford adhesion of the sheet around the photograph to a smooth firm surface of a substrate to thereby support the photograph and sheet along the surface of the substrate, while the adhesive coating on the sheet is removable from the surface of the substrate and edge portions of the photograph extending along said rear surface without damage thereto.

2. A frame according to claim 1 wherein said adhesive is a mixture of a permanent isooctyl acrylate/acrylic acid copolymer pressure sensitive adhesive and a repositionable pressure sensitive adhesive comprising inherently tacky elastomeric acrylate microspheres which are solid in nature, comprises from 5 to 20 percent of the permanent pressure sensitive adhesive and from 95 to 80 percent of the repositionable pressure sensitive adhesive, and is applied in a layer weighing in the range of 8.37 to 16.7 grams per square meter.

3. A frame according to claim 2 wherein said mixture comprises about 15 percent of the permanent pressure sensitive adhesive, about 85 percent of the repositionable pressure sensitive adhesive, and is applied in a layer weighing about 12. 6 grams per square meter.

4. A frame according to claim 1 wherein said sheet is of paper cover stock.

5. A frame according to claim 1 wherein said sheet is of polymeric material.

6. A frame according to claim 5 wherein said polymeric material is polyester in the range of 0.076 to 0.2 millimeter thick.

7. In combination, a frame adapted for use on photographs in a predetermined range of sizes, said frame comprising:

a flexible conformable generally planar sheet having a thickness of up to about 0.2 millimeter, opposite front and rear major surfaces, a peripheral edge between said major surfaces having length and width dimensions exceeding the length and width dimensions of photographs in said predetermined range of sizes by at least 12.7 millimeter, a generally centrally located viewing opening between said surfaces having a size and shape adapted to afford viewing of a central portion of a photograph in said range of sizes with edge portions of the photograph around said central portion extending along said rear surface; and a layer of repositionable pressure sensitive adhesive along said rear surface of said sheet, said adhesive affording firm adhesion and conformance of said sheet to the edge portions of the photograph extending along said rear surface to hold the photograph against the frame while being removable form the surface and the edge portions of the photograph extending along said rear surface without damage thereto; and a greeting card having opposite front and rear major surfaces, a peripheral edge between said major surfaces having length and width dimensions about the same as the length and width dimensions of said sheet, printed indicia on said rear surface, and a coating of release material on said front surface affording firm adhesion of the layer of adhesive on the sheet around the photograph to said front surface of said greeting card to thereby support the photograph and frame along said front surface, while affording removal of the layer of adhesive form the front surface of the greeting card without damage thereto.

8. A combination according to claim 7 wherein said adhesive is a mixture of a permanent isooctyl acrylate/acrylic acid copolymer pressure sensitive adhesive and a repositionable pressure sensitive adhesive comprising inherently tacky elastomeric acrylate microspheres which are solid in nature, comprises from 5 to 20 percent of the permanent pressure sensitive adhesive and from 95 to 80 percent of the repositionable pressure sensitive adhesive, and is applied in a layer weighing in the range of 8.37 to 16.7 grams per square meter.

9. A combination according to claim 8 wherein said mixture comprises about 15 percent of the permanent pressure sensitive adhesive, about 85 percent of the repositionable pressure sensitive adhesive, and is applied in a layer weighing about 12.56 grams per square meter.

10. A combination according to claim 7 wherein said sheet is of paper cover stock.

11. A combination according to claim 7 wherein said sheet is of polymeric material.

12. A combination according to claim 11 wherein said polymeric material is polyester in the range of 0.046 to 0.2 millimeter thick.

* * * * *